US008029427B1

(12) United States Patent
Troudt

(10) Patent No.: US 8,029,427 B1
(45) Date of Patent: Oct. 4, 2011

(54) PAINT ROLLER SYSTEM WITH SELECTIVELY LOCKABLE ROLLER

(75) Inventor: Kevin Troudt, Roswell, GA (US)

(73) Assignee: Hyde Tools, Inc., Southbridge, MA (US)

( * ) Notice: Subject to any disclaimer, the term of this patent is extended or adjusted under 35 U.S.C. 154(b) by 657 days.

(21) Appl. No.: 12/156,464

(22) Filed: May 31, 2008

Related U.S. Application Data

(60) Provisional application No. 60/932,819, filed on Jun. 2, 2007.

(51) Int. Cl.
*B05C 1/08* (2006.01)

(52) U.S. Cl. ..... 492/17; 492/16; 492/19; 15/230.11

(58) Field of Classification Search ..... 492/18, 492/17, 16, 19, 45, 20; 15/236.03, 230.11, 15/104.002
See application file for complete search history.

(56) References Cited

U.S. PATENT DOCUMENTS 1,645,357 A 10/1927 Skrzeczkowski
3,916,470 A * 11/1975 May ..... 15/98
4,196,491 A 4/1980 Baril
5,303,446 A 4/1994 Maresh
7,389,560 B2 * 6/2008 Mertins, Jr. ..... 15/230.11
2002/0187273 A1 12/2002 Robinson
2005/0011032 A1 1/2005 Bosler
2005/0050666 A1 3/2005 Schumm

* cited by examiner

*Primary Examiner* — David Bryant
*Assistant Examiner* — Christopher Besler
(74) *Attorney, Agent, or Firm* — Louis J. Franco; Law Office of Louis J. Franco

(57) ABSTRACT

A paint roller system includes a handle and an applicator support frame. The support frame has a base end by which it is connected to the handle and is configured to include an axle that is oriented generally orthogonally to the handle and includes a distal end. An interior frame channel extends between a first opening in the base end and a second opening in the distal end. A linkage snaked through the channel includes a first end coupled to an actuator carried by the handle and a second end terminating in a keyed lug. A roller disposed for rotation about the axle is configured to support for rotation a cylindrical paint applicator. The roller includes a keyed socket axially aligned with the second opening in the axle. The actuator is movable into a first position in which the keyed lug is disengaged from the keyed socket and that the roller is free to rotate, and a second position in which the lug protrudes from the second opening and into the keyed socket, thereby preventing roller rotation.

15 Claims, 3 Drawing Sheets

(Not to Scale)

Exploded view of the illustrative embodiment of FIG. 1

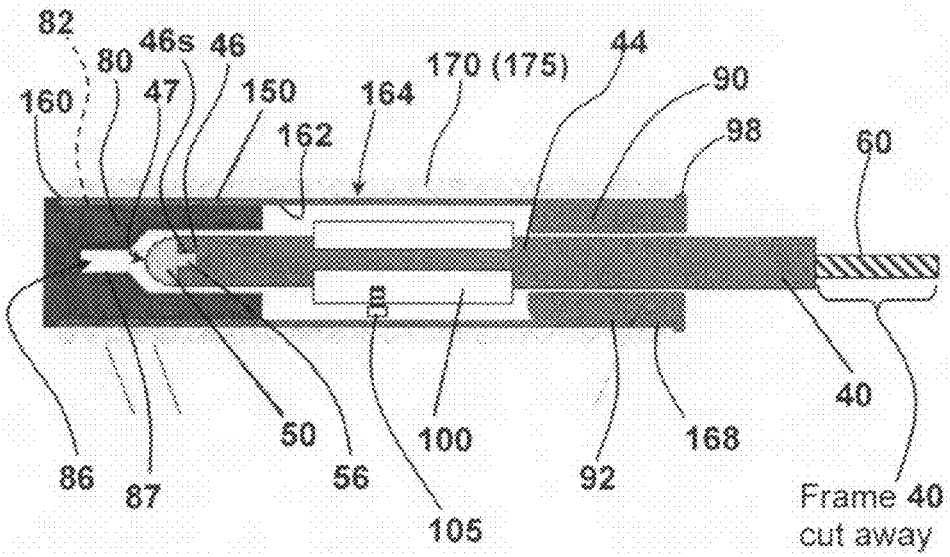
FIG. 3A
Lug disengaged from socket 86 and withdrawn into 50
FIG. 3B
Lug 66 engaged with socket 86, roller 80 is locked
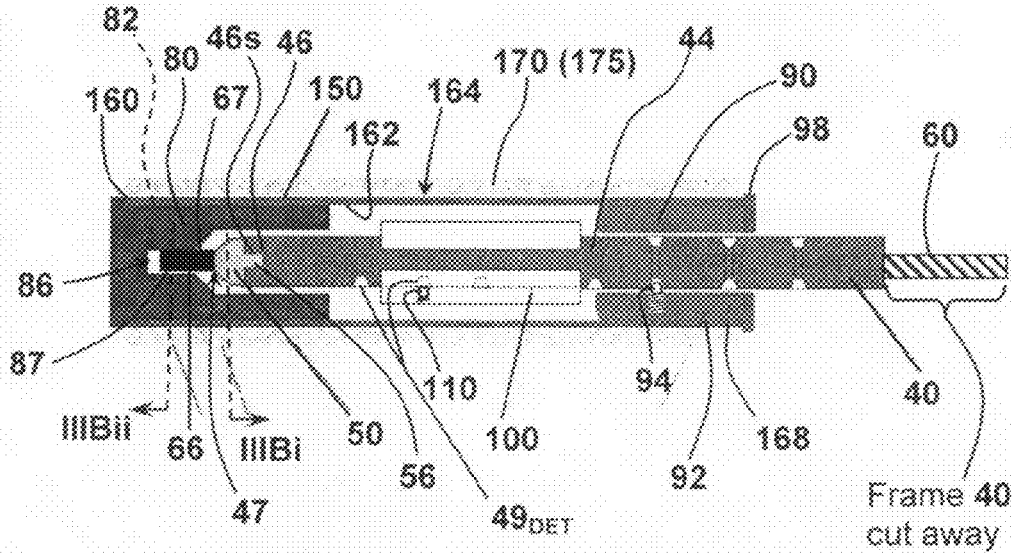
FIG. 3Bi
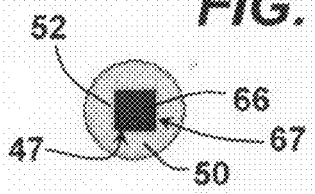
FIG. 3Bii
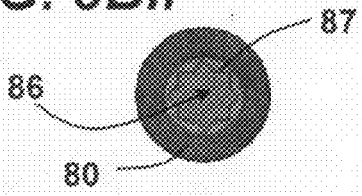

PAINT ROLLER SYSTEM WITH SELECTIVELY LOCKABLE ROLLER

PROVISIONAL PRIORITY CLAIM

Priority based on Provisional Application Ser. No. 60/932,819 filed Jun. 2, 2007, and entitled "PAINT ROLLER SYSTEM WITH SELECTIVELY LOCKABLE ROLLER" is claimed. The entirety of the disclosure of the previous provisional application, including the drawings, is incorporated herein by reference as if set forth fully in the present application.

BACKGROUND

As is commonly known, a paint brush includes bristles for holding paint and delivering paint to a given surface. The bristles spread the paint out evenly when a back and forth motion is employed, resulting in a relatively smooth finish. Typically, a paint roller holds more paint per "load," and delivers paint to a surface much more quickly, than a paint brush. However, as is known, a roller leaves a "stippled" or somewhat textured finish, which is attributable to the nap (pile) of the roller rolling over the surface to which paint is applied. There may be circumstances in which the speed and convenience of a roller, but not the textured application inherent in rolling paint onto a surface is desired.

Accordingly, there exists a need for a painting tool that facilitates the rapid application of a relatively large volume of paint characteristic of roller painting while providing a smooth finish more characteristic of brush-painted surfaces.

SUMMARY

In accordance with a first illustrative set of embodiments, a paint roller system with a selectively lockable roller (hereinafter, may be referred to as "paint roller system") includes an elongated handle extending longitudinally along a handle axis. The handle has longitudinally opposed front and back ends and, in various embodiments, has an interior void for housing internal components, examples of which are described further in the summary and in the detailed description. Depending from the handle and extending forward thereof is an applicator support frame for supporting a cylindrical applicator such as a paint roller cover by way of non-limiting example. In various versions, the applicator support frame is tubular and has a base portion that extends along, but not necessarily parallel to, the handle axis and includes a first opening. In various versions, the first opening communicates with the interior void of the handle. The applicator support frame is contoured so as to define an axle portion that is of a predetermined axle length and extends along, but not necessary parallel to, an axle axis that is oriented orthogonally to the handle axis. The axle portion includes a free distal end at which the applicator support frame terminates and has defined therein a second opening. Extending between and communicating with the first and second openings is a continuous interior frame channel.

An actuator that is carried by the handle includes a finger-engaging portion accessible from the exterior of the handle so that a user can selectively reciprocate the actuator between first and second actuator positions. A snaked flexible linkage extends through the frame channel and between a first linkage end that is linked to the actuator and an opposed second linkage end that corresponds with the distal end of the axle portion. The second linkage end terminates in a lug with a keyed periphery. By virtue of the lug's dependence from the flexible linkage and the attachment of the flexible linkage to the actuator, the lug can be caused to reciprocate relative to the distal end of the axle portion through corresponding reciprocation of the actuator. There is at least one position into which the actuator can be moved such that the lug extends through the second opening and protrudes relative to the distal end of the axle portion. In various versions, the first linkage end and the portion of the actuator to which the first linkage end is joined are situated within the interior void of the handle.

An outer roller is disposed for rotation about the distal end of the axle portion and configured to support for rotation about the axle portion a cylindrical paint applicator. A typical cylindrical paint applicator includes a cylindrical tubular core with an inside surface and an outside surface with a nap or pile of absorbent material adapted to alternatively absorb and distribute paint. Cylindrical paint applicators are some times referred to as roller covers and, accordingly, may be alternatively referred to as such in the summary, detailed description and claims of the present disclosure. In alternative versions, the outer roller is one of (i) integrally formed with the core of the roller cover, (ii) adhered into the roller-cover core with a suitable adhesive such as glue or epoxy and (iii) press fitted into, and removable from, the roller-cover core. In any case, the outer roller is variously configured to include a central socket defined by a keyed interior boundary. The interior boundary is configured to selectively engage with the keyed periphery of the lug. Again, by virtue of the linkage connecting the lug to the actuator, the first actuator position is such that the keyed periphery of the lug is not engaged with the keyed interior boundary of the socket. When the lug is in a non-engaged position, the outer roller is free to rotate about the axle portion. The second actuator position is such that the lug protrudes sufficiently through the second opening in the distal end of the axle portion for the keyed periphery of the lug to at least partially engage with the keyed interior boundary of the socket. When the lug is in a socket-engaging position, the outer roller is prevented from rotating about the axle portion and, consequently, a roller cover carried by the outer roller is selectively locked.

In various versions, the outer roller is selectively removable from the axle portion. However, when mounted for use, the outer roller must be retained on the axle portion such that it is not forced off or axially shifted to an extent that the socket boundary and lug periphery cannot mutually engage. In selected implementations, the paint roller system includes a second, inner roller with an annular outside surface configured to frictionally engage and support for rotation about the axle portion the inside surface of a roller-cover core adjacent the end of the roller-cover core opposite the end supported by the outer roller. In some versions, the inner roller is set in a fixed location along the length of the axle portion such that it cannot be slid along or off of the axle portion. In such a version, the outer roller is retained on the axle portion by virtue of the frictional engagement of the inside surface of the roller-cover core with the annular outside surface of the inner roller and, in alternative versions, one of (i) the frictional engagement of the outer roller with the inside surface of the roller-cover core and (ii) the mutual affixation or integral formation of the outer roller and the roller-cover core.

Embodiments alternative to those including an inner roller with an axially-fixed location include an inner roller that is movable into disparate axial positions, thereby rendering the paint roller system adaptable for use with roller covers of various lengths. In accordance with one configuration, an infinitely positionable inner roller is prevented from moving too far toward the distal end to keep the outer roller properly positioned by an infinitely positionable axial roller retainer that is situated between the inner and outer roller. The roller retainer is configured to selectively engage the axle portion of the support frame in a manner that prevents axial movement of the retainer and limits the axial movement of the inner roller toward the distal end of the axle portion. In one version, the roller retainer is a resilient member that frictionally engages the axle portion. In an alternative version, the roller retainer includes a set screw oriented for selective threadable movement toward and away from the axle portion.

In addition to embodiments in which at least one of the roller retainer and the inner roller is infinitely positionable along the axle portion, alternative versions provide for movement of at least one of a roller retainer and the inner roller into discretely defined axial positions. Such versions variously involve the mutual cooperation of detents and spring-loaded protrusion members.

Representative, non-limiting embodiments are more completely described and depicted in the following detailed description and the accompanying drawings.

BRIEF DESCRIPTION OF THE DRAWINGS

FIG. 3A shows an axle about which outer and inner rollers are mounted for rotation and support of a cylindrical paint applicator wherein there is defined in the outer roller a central keyed socket axially aligned with the end of the axle;

FIG. 3B shows the mechanisms of FIG. 3A wherein a keyed lug carried internally by the axle is protruding from an opening in the end of the axle and into the keyed socket defined within the outer roller such that the outer roller is selectively locked;

FIG. 3Bi is a cross-sectional view into plane IIIBi in FIG. 3B and shows the keyed lug of FIG. 3B supported within a keyed opening defined in the end of the axle; and FIG. 3Bii is a cross-sectional view into plane IIIBii in FIG. 3B and shows the keyed socket defined within the outer roller.

DETAILED DESCRIPTION

The following description of various embodiments of a paint roller system with a selectively lockable roller is illustrative in nature and is therefore not intended to limit the scope of the invention or its application of uses. Accordingly, the various implementations, aspects, versions and embodiments described in the summary and detailed description are in the nature of non-limiting examples falling within the scope of the appended claims and do not serve to define the maximum scope of the claims.

Figure 1:
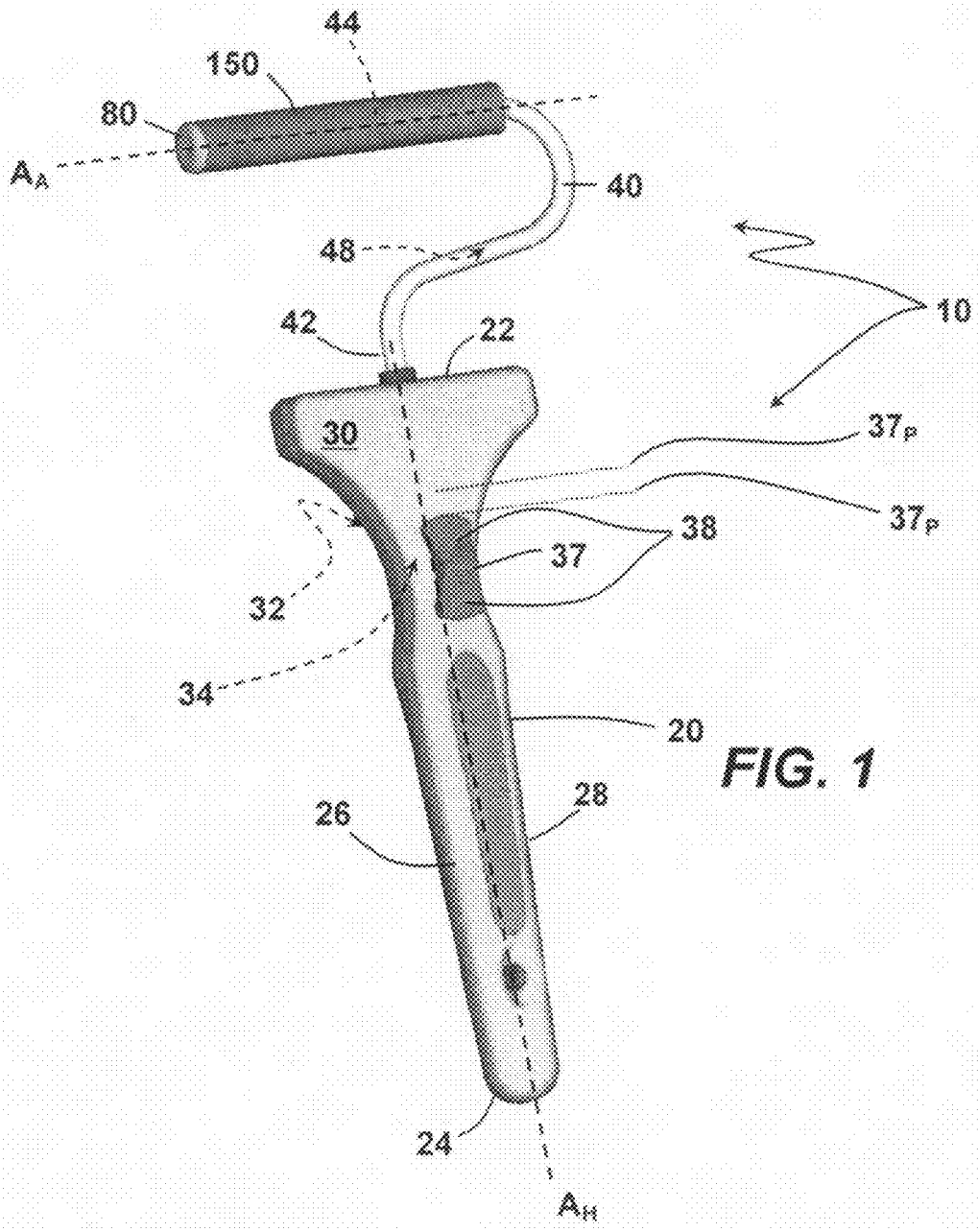
FIG. 1 shows an illustrative paint roller system with a selectively lockable roller.

Referring to FIG. 1, an illustrative paint roller system 10 includes an elongated handle 20 that extends longitudinally along a handle axis $A_H$ between front and back ends 22 and 24. The handle 20 of the version depicted further includes left and right sides 26 and 28 and top and bottom surfaces 30 and 32. The exploded view of FIG. 2 indicates that an interior void 34 is defined between the top and bottom surfaces 30 and 32 for housing internal components. An elongated opening 36 in the top surface 30 communicates with the interior void 34. The elongated opening 36 (i) provides access from the exterior of the handle 20 to a finger-engaging portion 38 of an actuator 37 and (ii) facilitates selective reciprocation of the actuator 37 between longitudinally distinct first and second actuator positions for purposes to be described later in the present description.

Figure 2:
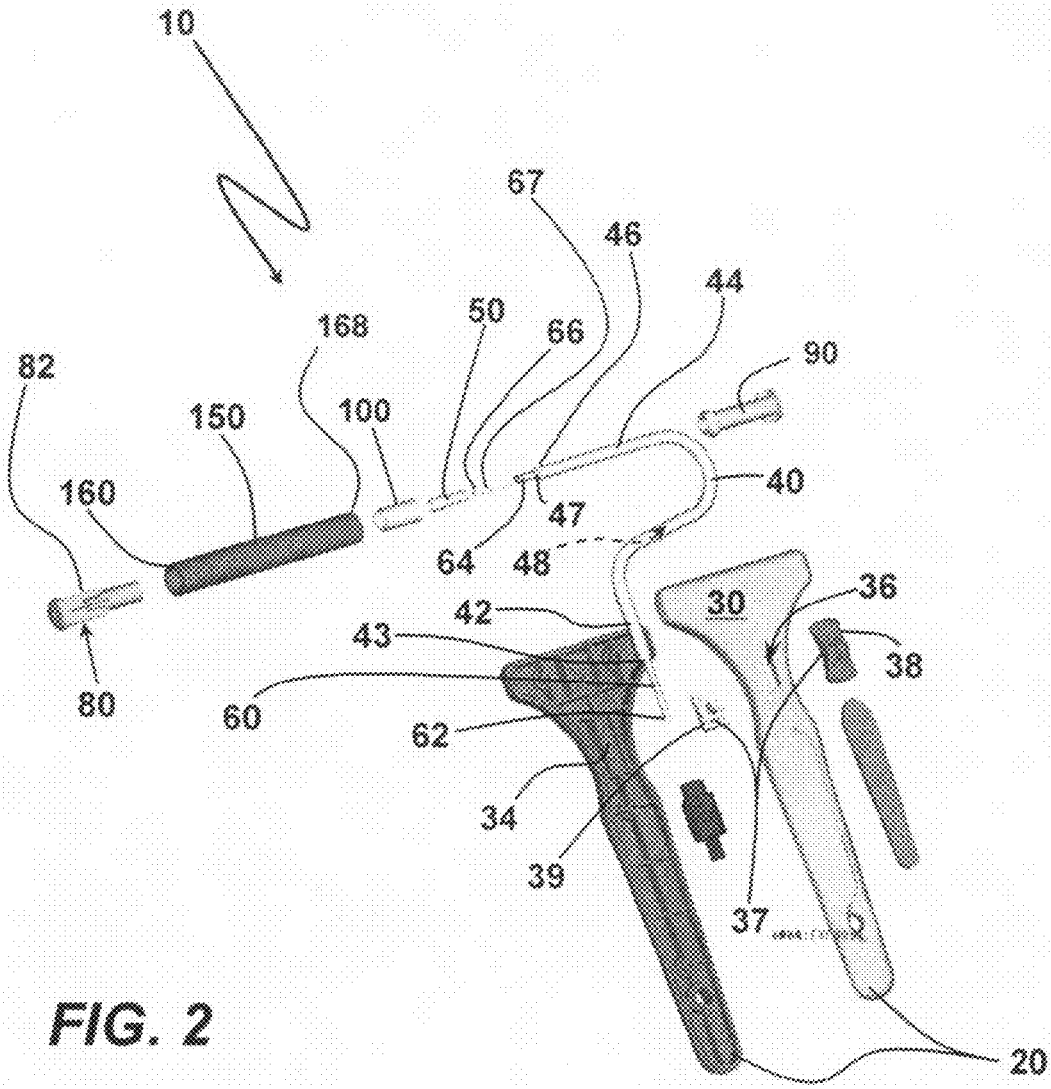
FIG. 2 depicts an exploded view of the paint roller system of FIG. 1.

Depending from the handle 20, and extending forward thereof, is an applicator support frame 40 for supporting a cylindrical applicator 150 such as a paint roller cover. The applicator support frame 40 is tubular and has a base portion 42 that extends along, but not necessarily parallel to, the handle axis $A_H$. With reference to FIGS. 1 and 2, the base portion 42 extends through the front end 22 of the handle 20 such that part of the base portion 42 is secured between the top and bottom surfaces 30 and 32 of the handle 20. The tubular applicator support frame 40 is contoured so as to define an axle portion 44 that is of a predetermined axle length and extends along, but not necessary parallel to, an axle axis $A_A$ that is oriented orthogonally to the handle axis $A_H$. The axle portion 44 includes a free distal end 46 at which the applicator support frame 40 terminates. An interior frame channel 48 extends throughout the length of the applicator support frame 40 between a first opening 43 defined in the base portion 42 and a second opening 47 defined in the distal end 46.

Referring to the exploded view of FIG. 2, a flexible linkage 60 extends through the frame channel 48 and between a first linkage end 62 that is linked to an internal actuator portion 39 of the actuator 37 and an opposed second linkage end 64 that corresponds with the distal end 46 of the axle portion 44. The second linkage end 64 terminates in a lug 66 with a keyed periphery 67 (e.g., a periphery having a cross-sectional profile that is other-than-circular). In alternative illustrative versions, the lug 66 is one of (i) integrally formed with the remainder of flexible linkage 60 and (ii) affixed to the second linkage end 64 with a suitable bonding agent such as epoxy, welding, or heat-fusing, by way of non-limiting example. By virtue of the dependence of the lug 66 from the flexible linkage 60, and the attachment of the first linkage end 62 to the actuator 37, the lug 66 can be caused to reciprocate relative to the distal end 46 of the axle portion 44 through corresponding reciprocation of the actuator 37. There is at least one position into which the actuator 37 can by moved such that the lug 66 extends through the second opening 47 and protrudes relative to the distal end 46 of the axle portion 44. In the illustrative version of FIGS. 1 and 2, the first linkage end 62 and the portion of the actuator 37 (i.e., the internal actuator portion 39) to which the first linkage end 62 is joined are situated within the interior void 34 of the handle 20.

As shown to varying degrees in each of FIGS. 1 through 3B, an outer roller 80 is disposed for rotation about the distal end 46 of the axle portion 44. The outer roller 80 is configured to support for rotation about the axle portion 44 a cylindrical paint applicator 150. A typical cylindrical paint applicator 150 includes a cylindrical tubular roller-cover core 160 with inside and outside surfaces 162 and 164 and a nap 170 (or pile) of absorbent material 175 configured to alternatively absorb paint from a paint source (not shown) and distribute paint to a surface (not shown). As explained in the summary, a cylindrical paint applicator 150 may be referred to as a "roller cover 150" for purposes of the present description and the appended claims. In alternative versions, the outer roller 80 is one of (i) integrally formed with the roller-cover core 160, (ii) adhered to the inside surface 162 of the roller-cover core 160 with a suitable adhesive such as glue or epoxy and (iii) press fitted into, and removable from, the roller-cover core 160. The first two of the three illustrative alternatives represent examples of roller covers 150 that are intended for use with embodiments of a paint roller system 10 to specifically designed for use with such "custom" roller covers 150; that is, roller covers 150 each of which includes the outer roller 80 situated within the roller-cover core 160 thereof. The third illustrative alternative provides the flexibility of removably mounting a generic roller cover of standard dimensions over an annular outside surface 82 of the outer roller 80. All three illustrative arrangements are accounted for in FIGS. 3A and 3B by indicating an annular outer surface 82 with a dashed lead line; this indicates the third alternative in which roller cover 150 is a generic roller cover 150 with a portion of the inside surface 162 of the roller-cover core 160 frictionally engaged with the outside surface 82 of the outer roller 80. It will be appreciated that, in any event, the outer roller 80 supports an outer end 166 of the roller-cover core 160 for rotation about the axle portion 44.

Regardless of whether the outer roller 80 is affixed within the roller-cover core 160 of a roller cover 150 or separable therefrom, the outer roller 80 is configured to include a central socket 86 defined by a keyed interior boundary 87. The interior boundary 87 is configured to selectively engage the keyed periphery 67 of the lug 66 when the outer roller 80 is operatively situated about the distal end 46 of the axle portion 44, as in FIGS. 1, 3A and 3B. FIG. 3B ii is a view into the plane IIIBii of FIG. 3B and shows an illustrative keyed interior boundary 87 defining the central socket 86. The illustrative keyed interior boundary 87 of FIG. 3B ii exhibits a profile that is essentially that of two overlaid squares offset by 45-deg. This profile accommodates the insertion of a square lug 66 well by statistically increasing the probability of insertion relative to a square interior boundary (not shown), for example. It will be appreciated that the profile of the interior boundary 87 in FIG. 3B ii provides an opportunity for the square lug 66 of FIG. 3Bi to be inserted every 45 degrees as opposed, for example, to every 90 degrees. It will also be appreciated that the locations of the lug 66 and the socket 86 could be reversed. More specifically, the keyed interior boundary 87 of the socket 86 could be formed in the second linkage end 64 and the lug 66 with keyed periphery 67 could be to defined on the outer roller 80, although the first-described arrangement will typically be easier to manufacture. While only the first arrangement is shown in the drawings, the relevant figures are regarded as sufficiently illustrative to support the reverse arrangement and, therefore, the reverse arrangement is not explicitly illustrated.

Again, by virtue of the flexible linkage 60 rendering mechanical communication is between the lug 66 and the actuator 37, a first actuator position is such that the keyed periphery 67 of the lug 66 is not engaged with the keyed interior boundary 87 of the central socket 86. When the lug 66 is in a non-engaged position, as shown in FIG. 3A, the outer roller 80 is free to rotate about the axle portion 44 of the applicator support frame 40. A second actuator position is such that the lug 66 protrudes sufficiently through the second opening 47 in the distal end 46 of the axle portion 44 for the keyed periphery 67 of the lug 66 to at least partially engage with the keyed interior boundary 87 of the central socket 86. When the lug 66 is in a socket-engaging position, as shown in FIG. 3B, the outer roller 80 is prevented from rotating about the axle portion 44 and, consequently, a roller cover 150 carried by the outer roller 80 is selectively locked. Indicated with dashed lead lines in FIG. 1 are illustrative first and second actuator positions $\mathbf{37}_{P1}$ and $\mathbf{37}_{P2}$ corresponding to, respectively, a position in which the lug 66 is not engaged with the central socket 86, as in FIG. 3A, and a position in which the lug 66 is engaged with the central socket 86, as in FIG. 3B.

In order for the lug 66 to selectively "lock up" the outer roller 80, the flexible linkage 60 is itself prevented from being twisted by torsional forces applied through the outer roller 80 such as, for example, when a roller cover 150 carried by the outer roller 80 is moved along a surface being painted. Illustrative mechanisms for preventing rotation of the lug 66 within the second opening 47 are explained with reference to FIG. 3Bi. Generally, the second opening 47 may be formed with a keyed interior border 52 defining a cross-sectional profile that cooperatively mates with the cross-sectional profile of the keyed periphery 67 of the lug 66 in order to prevent rotation of the lug 66 within the second opening 47. It will be appreciated that the cross-sectional geometries of the keyed periphery 67 and the interior border 52 need not be identical; they need only cooperate in a manner that prevents the aforementioned rotation. However, the cross-sectional view of FIG. 3Bi, which is a view into plane IIIBi of FIG. 3B, shows a lug 66 defined by a square-shaped periphery 67 in a second opening 47 having a square-shaped interior border 52. In some versions, the second opening 47 is formed directly in the material from which the support frame 40 is fabricated. However, with reference to FIGS. 2, 3A and 3B, the distal end 46 may be fitted with a lug guide 50 within which the second opening 47 is formed. In the illustrative version of FIGS. 3A and 3B, the lug guide 50 is partially inserted into the frame channel 48. In the version depicted in the drawings, the lug guide 50 is prevented from rotating with the frame channel 48 by the engagement of a protrusion 56 on the lug guide 50 with a slot 46*s* formed in the distal end 46 of the axle portion 44. However, it will be appreciated that numerous alternative ways of preventing the rotation of a lug guide such as lug guide 50 will occur to those of ordinary skill in the relevant arts. By way of non-limiting example, the lug guide 50 may be secured to the distal end 46 by an adhesive such as epoxy. It will also be appreciated that rotation within the frame channel 48 is a concern when, as in the case of the version of FIGS. 1 through 3B, the frame channel 48 is of circular cross section.

In a typical version, the outer roller 80 is selectively removable from the axle portion 44 of the applicator support frame 40. Removability of the outer roller 80 is required of versions in which the outer roller 80 is affixed within, or integrally formed with, the roller-cover core 160. While removability of the outer roller 80 is theoretically optional in versions accepting of generic roller covers 150, as a practical matter, the outer roller 80 should still be removable so that it can be fitted into the end of the roller cover 150 chosen to correspond with the distal end 46 of the axle portion 44 without the need to slide nearly the entire length of the roller cover 150 over the outer roller 80. Such "full-length" sliding would be extremely difficult where a tight frictional engagement between the annular outside surface 82 of the outer roller 80 and the inside surface 162 of the roller-cover core 160 is desired, and impossible in versions in which the outer roller 80 includes a flanged portion 88 that is larger in diameter than the inner diameter of the roller-cover core 160 and configured to prevent the outer roller 80 from extending too far into the roller-cover core 160.

In various versions in which the outer roller 80 is selectively removable from the axle portion 44 of the applicator support frame 40, mechanisms are provided for retaining the outer roller 80 on the axle portion 44 with sufficient resistance to prevent the lug 66 from pushing the outer roller 80 off the axle portion 44 when the lug 66 is extended toward the central socket 86. The version of FIGS. 1 through 3B includes a second, inner roller 90. As shown most clearly in FIGS. 3A and 3B, the inner roller 90 includes an annular outside surface 92 configured to frictionally engage, and support for rotation about the axle portion 44, the inside surface 162 of a roller-cover core 160 adjacent an inner end 168 thereof, opposite, and axially spaced from, the outer end 166. In some versions, the inner roller 90 is set in a fixed location along the length of the axle portion 44 such that it cannot be slid along or off of the axle portion 44. In such a version, the outer roller 80 is retained on the axle portion 44 by virtue of the frictional engagement of the inside surface 162 of the roller-cover core 160 with the annular outside surface 92 of the inner roller 90 and, in alternative versions, one of (i) the frictional engagement of the outer roller 80 with the inside surface 162 of the roller-cover core 160 and (ii) the mutual affixation or integral formation of the outer roller 80 and the roller-cover core 160.

Although a configuration having an inner roller 90 with a single fixed axially position is well within the scope and contemplation of the invention as expressed in the appended claims, one will readily appreciate that such a version is limited in terms of the length of the roller cover 160 that can be mounted thereto. This limitation is particularly manifest when, as in the example of FIGS. 3A and 3B, the inner roller 90 includes a flanged portion 98 that is larger in diameter than the inner diameter of the roller-cover core 160 and configured to prevent the inner roller 90 from extending too far into the roller-cover core 160. Accordingly, included within the scope and contemplation of the invention are versions onto which roller covers 150 of disparate lengths can be alternatively retained for rotation about the axle portion 44. Referring to FIGS. 2, 3A and 3B, the inner roller 90 is axially slidable along the axle portion 44 of the applicator support frame 40. Preventing the inner roller 90 from sliding off the axle portion 44, or too far toward the distal end 46 to retain the outer roller 80 in a proper axial position, is an axial roller retainer 100. In some versions, the roller retainer 100 is fabricated from a resilient material and configured to frictionally engage, and at least partially surround, the axle portion 44. In such a version, the roller retainer 100 is infinitely positionable along the axle portion 44, between the outer and inner rollers 80 and 90, and used to selectively define a minimum distance from the distal end 46 of the axle portion 44 into which the inner roller 90 can be slid. For purposes of illustration to a person of ordinary skill in the relevant art(s), the roller retainer 100 of FIG. 3A can be regarded as one that is flexible and frictionally engages the axle portion 44 of the applicator support frame 40. In an alternative version, an infinitely positionable roller retainer 100 is carries a set screw for selective position setting. Although is unlikely that any one version would include a roller retainer 100 that is both flexible and includes a set screw, for purposes of illustrating such an alternative version, and efficient inclusion of drawings, the roller retainer 100 of FIG. 3A is shown with a set screw 105 that can be threadably urged into contacting engagement with the axle portion 44 of the support frame 40 to "set" or "lock" the roller retainer 100 in a selected axial position. For purposes of this latter, alternative version, the roller retainer 100 of FIG. 3A is generally envisioned as rigid.

In still additional alternative versions, described with reference to FIG. 3B, a roller retainer 100 includes one or more spring-loaded protrusion members 110 (e.g., a ball and tapered pin) that can be selectively biased into disparate, axially-spaced detents $\mathbf{49}_{DET}$ situated along the axle portion 44. In various such versions, detent positions are selected so that the inner roller 90 can assume various pre-defined axial positions that are compatible with standardized roller cover lengths. In still additional versions, the inner roller 90 is "self-retaining" and carries at least one spring-loaded protrusion member 94 that, when aligned with a detent $\mathbf{49}_{DET}$ along the axle portion 44, is biased radially inward for protrusion beyond the annular inside surface 96 of the inside roller 90. In order to ensure unimpeded rotation of the inner roller 90, each detent $\mathbf{49}_{DET}$ of various versions is defined by an axially-localized reduction in the diameter of the axle portion 44 such that an annular protrusion race $\mathbf{49}_{RACE}$ of constant radius is defined. In versions in which the inner roller 90 is self-retaining, no additional roller retainer, separate and distinct from the inner roller 90 (i.e., such as retainer 100), is required; that is, the inner roller 90 also serves as the roller retainer.

The foregoing is considered to be illustrative of the principles of the invention. Furthermore, since modifications and changes to various aspects and implementations will occur to those skilled in the art without departing from the scope and spirit of the invention, it is to be understood that the foregoing does not limit the invention as expressed in the appended claims to the exact constructions, implementations and versions shown and described.

What is claimed is:

1. A paint roller system comprising:

a handle;

an applicator support frame depending from the handle, wherein the applicator support frame (i) has a base portion that includes a first opening, (ii) is contoured so as to define an axle portion, the axle portion including a free distal end including a second opening, and (iii) includes an interior frame channel extending between, and communicating with, the first and second openings;

an actuator carried by the handle and including a finger-engaging portion accessible from the exterior of the handle for reciprocation of the actuator between first and second actuator positions;

a flexible linkage snaked through the frame channel and including a first linkage end coupled to the actuator and a second linkage end corresponding with the distal end of the axle portion and terminating in one of (i) a lug with a keyed periphery and (ii) a socket with a keyed interior boundary;

a roller disposed for rotation about the axle portion and configured to support for rotation about the axle portion a cylindrical paint applicator, the roller including the other of (i) the lug with the keyed periphery and (ii) the central socket with a keyed interior boundary; wherein (i) the second linkage end is prevented from rotating relative to the distal end of the axle portion, (ii) the first actuator position is such that the keyed periphery of the lug is not engaged with the keyed interior boundary of the socket such that the roller is free to rotate about the axle portion, and (iii) the second actuator position is such that the keyed periphery of the lug is at least partially engage with the keyed interior boundary of the socket such that the roller is prevented from rotating about the axle portion.

2. The paint roller system of claim 1 wherein the handle extends longitudinally along a handle axis and the axle portion extends along an axle axis that is oriented orthogonally to the handle axis.

3. The paint roller system of claim 2 wherein the socket is defined in the roller and the second linkage end is terminated with the lug.

4. The paint roller system of claim 3 wherein the second opening is formed with a keyed interior border defining a cross-sectional profile that cooperatively mates with the cross-sectional profile of the keyed periphery of the lug in order to prevent rotation of the lug within the second opening.

5. The paint roller system of claim 1 wherein the socket is defined in the roller and the second linkage end is terminated with the lug.

6. The paint roller system of claim 5 wherein the second opening is formed with a keyed interior border defining a cross-sectional profile that cooperatively mates with the cross-sectional profile of the keyed periphery of the lug in order to prevent rotation of the lug within the second opening.

7. A paint roller system comprising:

an elongated handle extending longitudinally along a handle axis and having a back end and a front end longitudinally opposite the back end;

a tubular applicator support frame depending from the handle and extending forward of the handle, wherein the applicator support frame (i) has a base portion that extends along the handle axis and includes a first opening, (ii) is contoured so as to define an axle portion that is of a predetermined axle length and extends along an axle axis that is oriented orthogonally to the handle axis, the axle portion including a free distal end having a second opening defined therein, and (iii) includes an interior frame channel extending between, and communicating with, the first and second openings;

an actuator carried by the handle and including a finger-engaging portion accessible from the exterior of the handle for reciprocation of the actuator between first and second actuator positions;

a flexible linkage snaked through the frame channel and including a first linkage end coupled to the actuator and a second linkage end corresponding with the distal end of the axle portion and terminating in a lug with a keyed periphery;

an outer roller disposed for rotation about the distal end of the axle portion and configured to support for rotation about the axle portion an outer end of a cylindrical paint applicator, the outer roller including a central socket with a keyed interior boundary configured to selectively engage with the keyed periphery of the lug; wherein (i) the first actuator position is such that the keyed periphery of the lug is not engaged with the keyed interior boundary of the socket such that the outer roller is free to rotate about the axle portion and (ii) the second actuator position is such that the lug protrudes sufficiently through the second opening in the distal end of the axle portion for the keyed periphery of the lug to at least partially engage with the keyed interior boundary of the socket such that the outer roller is prevented from rotating about the axle portion.

8. The paint roller system of claim 7 wherein the second opening is formed with a keyed interior border defining a cross-sectional profile that cooperatively mates with the cross-sectional profile of the keyed periphery of the lug in order to prevent rotation of the lug within the second opening.

9. The paint roller system of claim 7 wherein the cylindrical paint applicator includes a roller-cover core with an inner end and an inside surface, and the paint roller system further includes an inner roller with an annular outside surface to configured to frictionally engage, and support for rotation, the inside surface of the roller-cover core adjacent the inner end thereof.

10. The paint roller system of claim 9 wherein the inner roller is axially slidable along the axle portion of the applicator support frame such that cylindrical paint applicators of disparate lengths can be alternatively retained for rotation about the axial portion.

11. The paint roller system of claim 10 further including a roller retainer for at least one of (i) preventing the inner roller from sliding off the axle portion and (ii) selectively defining a minimum distance from the end of the axle portion into which the inner roller can be slid.

12. The paint roller system of claim 11 wherein (i) the roller retainer is a structure distinct from the inner roller, (ii) is infinitely positionable between the inner and outer rollers, and (iii) carries a set screw for selective position setting.

13. The paint roller system of claim 11 wherein the axle portion includes axially-spaced detents and the roller retainer includes a spring-loaded protrusion that can be selectively biased into each detent such that the detents pre-define a plurality of axial positions in which the roller retainer can be retained.

14. The paint roller system of claim 13 wherein the roller retainer is a structure distinct from the inner roller and is situated between the inner and outer rollers.

15. The paint roller system of claim 13 wherein the spring-loaded protrusion is carried by the inner roller such that the inner roller is selectively self-retaining.

* * * * *